US011531299B2

(12) United States Patent
Mori et al.

(10) Patent No.: US 11,531,299 B2
(45) Date of Patent: Dec. 20, 2022

(54) IMAGE CARRIER UNIT AND IMAGE FORMING APPARATUS INCLUDING THE SAME

(71) Applicant: KYOCERA Document Solutions Inc., Osaka (JP)

(72) Inventors: Hayato Mori, Osaka (JP); Kazuhisa Hirahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/526,554

(22) Filed: Nov. 15, 2021

(65) Prior Publication Data

US 2022/0155723 A1 May 19, 2022

(30) Foreign Application Priority Data

Nov. 19, 2020 (JP) ..... JP2020-192243

(51) Int. Cl.
*G03G 21/18* (2006.01)
*G03G 21/00* (2006.01)
*G03G 15/02* (2006.01)

(52) U.S. Cl.
CPC ..... *G03G 21/1832* (2013.01); *G03G 15/0225* (2013.01); *G03G 21/0011* (2013.01); *G03G 21/1864* (2013.01); *G03G 2221/1609* (2013.01)

(58) Field of Classification Search
CPC ..... G03G 21/1832; G03G 15/0225; G03G 21/0011; G03G 21/1864; G03G 2221/1609
See application file for complete search history.

(56) References Cited

U.S. PATENT DOCUMENTS

| | | | | |
|---|---|---|---|---|
| 8,798,501 | B2 * | 8/2014 | Hayashi | G03G 15/0173 399/119 |
| 9,915,888 | B2 * | 3/2018 | Morishita | G03G 15/0225 |
| 9,939,751 | B2 * | 4/2018 | Tsuchiya | G03G 15/0233 |
| 10,209,641 | B2 * | 2/2019 | Okura | G03G 15/0216 |
| 11,209,742 | B1 * | 12/2021 | Minamoto | G03G 21/0058 |
| 2007/0183809 | A1 * | 8/2007 | Ishikawa | G03G 15/0225 399/176 |
| 2010/0054799 | A1 * | 3/2010 | Nakamura | G03G 21/1832 399/114 |

(Continued)

FOREIGN PATENT DOCUMENTS

| | | |
|---|---|---|
| JP | 2010-256610 A | 11/2010 |
| JP | 2006-337725 A | 12/2016 |

*Primary Examiner* — Ryan D Walsh
(74) *Attorney, Agent, or Firm* — Stein IP, LLC

(57) ABSTRACT

An image carrier unit includes an image carrier including a cylindrical main body portion and a pair of flange portions attached to both ends of the main body portion, a first cleaning member that rotates in contact under a prescribed pressure with an outer circumferential surface of the main body portion, a unit frame that rotatably supports the image carrier and the first cleaning member, and an image carrier protective cover that includes a cover main body extending in an axial direction of the image carrier and a side surface portion that is disposed on one end side of the cover main body. On the side surface portion, an image carrier holding portion is formed that performs positioning of the image carrier with respect to the unit frame and releases a pressure contact state between the image carrier and the first cleaning member.

8 Claims, 8 Drawing Sheets

(56) References Cited

U.S. PATENT DOCUMENTS

| | | | | |
|---|---|---|---|---|
| 2011/0222905 | A1* | 9/2011 | Iikura | G03G 21/181 399/114 |
| 2015/0043940 | A1* | 2/2015 | Tsuji | G03G 21/0058 399/176 |
| 2017/0139341 | A1* | 5/2017 | Morishita | G03G 15/0258 |
| 2022/0163903 | A1* | 5/2022 | Katsumata | G03G 15/0216 |

* cited by examiner

IMAGE CARRIER UNIT AND IMAGE FORMING APPARATUS INCLUDING THE SAME

INCORPORATION BY REFERENCE

This application is based upon and claims the benefit of priority from the corresponding Japanese Patent Application No. 2020-192243 (filed on Nov. 19, 2020), the entire contents of which are incorporated herein by reference.

BACKGROUND

The present disclosure relates to an image carrier unit and an image forming apparatus including the same. The image carrier unit includes an image carrier, a cleaning member that makes contact with the image carrier so as to clean a surface thereof, and a demountable image carrier protective cover that protects the image carrier.

There is conventionally known an image carrier unit including a photosensitive drum (image carrier) on which an electrostatic latent image is formed and a charging device that charges the photosensitive drum. The charging device includes a charging roller that makes contact with the photosensitive drum so as to charge the photosensitive drum, a cleaning roller (cleaning member) that makes contact with the charging roller so as to clean the charging roller, and a biasing member that biases the charging roller toward the photosensitive drum.

In the image carrier unit configured as above, when stored in contact with the photosensitive drum for a long period of time, the charging roller might be permanently deformed under a contact pressure. There might also occur a phenomenon (bleeding phenomenon) in which a rubber component of the charging roller adheres to a surface of the photosensitive drum. As a result, there has been a fear of occurrence of charging abnormality of the photosensitive drum, which might adversely affect an image being formed.

To solve these problems, a method has been proposed in which the photosensitive drum and the charging roller are held in a separated state from each other, and there is known, for example, a configuration in which in an integral process cartridge including a charging roller biased into contact with a photosensitive drum by an elastic member, a charging roller separation member is provided that is capable of separating the charging roller from the photosensitive drum.

There is also known a photosensitive member protective cover that is demountably mounted to and protects a photosensitive cartridge including a photosensitive drum and a charging roller that makes contact with the photosensitive drum so as to charge the photosensitive drum. The photosensitive member protective cover includes a drum protective portion that protects the photosensitive drum and a separation portion that separates the photosensitive drum from the charging roller.

SUMMARY

An image carrier unit according to one aspect of the present disclosure includes an image carrier, a first cleaning member, a unit frame, and an image carrier protective cover and is mountable/demountable with respect to a main body of an image forming apparatus. The image carrier includes a cylindrical main body portion and a pair of flange portions attached to both ends of the main body portion, and a toner image is formed on a surface of the main body portion. The first cleaning member rotates in contact under a prescribed pressure with an outer circumferential surface of the main body portion so as to remove residual toner remaining on the surface of the main body portion. The unit frame rotatably supports the image carrier and the first cleaning member. The image carrier protective cover is mountable/demountable with respect to the unit frame and protects the image carrier. The image carrier protective cover includes a cover main body that extends in an axial direction of the image carrier and protects the image carrier and a side surface portion that is disposed on one end side of the cover main body, and on the side surface portion, an image carrier holding portion is formed that is inserted into one of the pair of flange portions and performs positioning of the image carrier with respect to the unit frame. While performing the positioning of the image carrier, the image carrier holding portion releases a pressure contact state between the image carrier and the first cleaning member.

DETAILED DESCRIPTION

Figure 1:
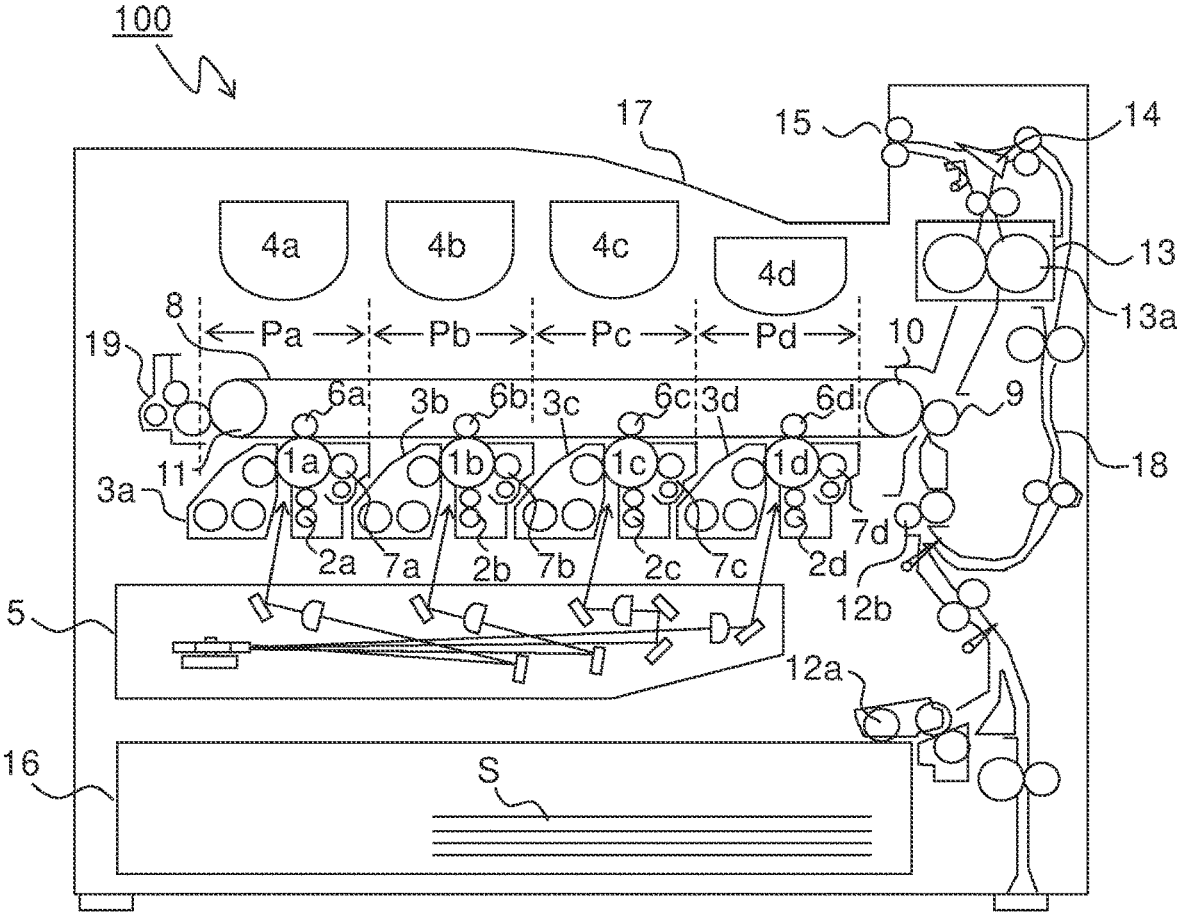
FIG. 1 is a sectional view showing a schematic configuration of an image forming apparatus in which a drum unit of the present disclosure is mounted.

With reference to the appended drawings, the following describes an embodiment of the present disclosure. FIG. 1 is a sectional view showing a schematic configuration of an image forming apparatus 100 in which drum units (image carrier units) 40*a* to 40*d* of the present disclosure are mounted. In a main body of the image forming apparatus 100, four image forming portions Pa, Pb, Pc, and Pd are provided in order from an upstream side in a conveyance direction (a left side in FIG. 1). The image forming portions Pa to Pd are provided so as to correspond to images of four different colors (magenta, cyan, yellow, and black), respectively, and each of the image forming portions Pa to Pd performs steps of charging, exposure, development, and transfer so that they sequentially form images of magenta, cyan, yellow, and black, respectively.

The image forming portions Pa to Pd include photosensitive drums 1*a*, 1*b*, 1*c*, and 1*d*, respectively, that are provided therein to carry visible images (toner images) of the respective colors. Moreover, an intermediate transfer belt 8 that rotates in a counterclockwise direction in FIG. 1 is provided adjacently to the image forming portions Pa to Pd. Toner images formed on the photosensitive drums 1*a* to 1*d* are sequentially transferred on the intermediate transfer belt 8 traveling in contact with the photosensitive drums 1*a* to 1*d*, and then the toner images are transferred at a time on a sheet S as an example of a recording medium in a secondary transfer unit 9. Moreover, after the images are fixed on the sheet S a fixing portion 13, the sheet S is discharged from the main body of the image forming apparatus 100. An image forming process with respect to the photosensitive drums 1*a* to 1*d* is performed while the photosensitive drums 1*a* to 1*d* are being rotated in a clockwise direction in FIG. 1.

The sheet S on which a toner image is to be transferred is contained in a sheet cassette 16 disposed in a lower part in the image forming apparatus 100, and the sheet S is conveyed to the secondary transfer roller 9 via a paper feed roller 12*a* and a registration roller pair 12*b*.

Next, a description is given of an image forming procedure performed in the image forming apparatus 100. Upon an input of an image forming instruction from a host apparatus such as a personal computer, the photosensitive drums 1*a* to 1*d* are first started to rotate by a main motor (not shown), and a surface of each of the photosensitive drums 1*a* to 1*d* is uniformly charged by a charging roller 21 (see FIG. 2) of a corresponding one of charging devices 2*a* to 2*d*. Then, the surface of each of the photosensitive drums 1*a* to 1*d* is irradiated with beam light (laser light) emitted from an exposure device 5 so that an electrostatic latent image corresponding to an image signal is formed on the each of the photosensitive drums 1*a* to 1*d*.

Each of developing devices 3*a* to 3*d* is filled with a prescribed amount of toner of a corresponding one of the respective colors of magenta, cyan, yellow, and black. In a case inhere a percentage of toner in a two-component developer filled in each of the developing devices 3*a* to 3*d* falls below a predetermined value due to after-mentioned toner image formation, the developing devices 3*a* to 3*d* are replenished with toner from toner containers 4*a* to 4*d*, respectively. The toner in the developer is supplied onto each of the photosensitive drums 1*a* to 1*d* by a developing roller 25 (see FIG. 2) of a corresponding one of the developing devices 3*a* to 3*d* and electrostatically adheres thereto. Thus, there is formed a toner image corresponding to the electrostatic latent image formed by exposure from the exposure device 5.

Further, by each of primary transfer rollers 6*a* to 6*d*, a prescribed transfer voltage is applied between itself and a corresponding one of the photosensitive drums 1*a* to 1*d*, and thus the toner images of magenta, cyan, yellow, and black on the photosensitive drums 1*a* to 1*d* are primarily transferred on the intermediate transfer belt 8. These images of the four different colors are formed in a prescribed positional relationship predetermined for formation of a prescribed full-color image. After that, residual toner remaining on the surface of each of the photosensitive drums 1*a* to 1*d* is removed by a corresponding one of cleaning devices 7*a* to 7*d* in preparation for subsequent formation of a new electrostatic latent image.

When the intermediate transfer belt 8 starts to rotate in the counterclockwise direction as a drive roller 10 is driven to rotate by a belt drive motor (not shown), at prescribed timing, the sheet S is conveyed from the registration roller pair 12*b* to the secondary transfer roller 9 provided adjacently to the intermediate transfer belt 8, and the full-color image is transferred thereon by the secondary transfer roller 9. The sheet S on which the toner images have been transferred is conveyed to the fixing portion 13. Residual toner remaining on a surface of the intermediate transfer belt 8 is removed by a belt cleaning unit 19.

The sheet S thus conveyed to the fixing portion 13 is heated and pressed by a fixing roller pair 13*a* so that the toner images are fixed on a surface of the sheet S, and thus the prescribed full-color image is formed thereon. A conveyance direction of the sheet S on which the full-color image has been formed is switched by a branch portion 14 branching off in a plurality of directions, and thus the sheet S is directly (or after being conveyed to a double-sided conveyance path 18 and thus being subjected to double-sided printing) discharged to a discharge tray 17 by a discharge roller pair 15.

Figure 2:
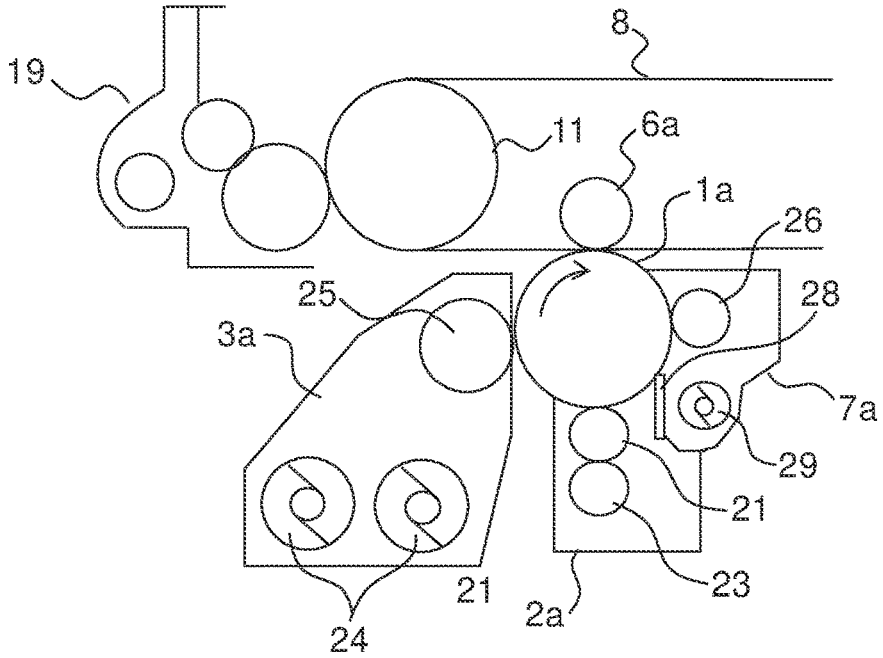
FIG. 2 is a partial sectional view showing, in an enlarged scale, a vicinity of an image forming portion in FIG. 1.

Next, a description is given of the image forming portions Pa to Pd. FIG. 2 is a partially enlarged view of a vicinity of the image terming portion Pa in FIG. 1. While the following describes the image forming portion Pa in detail, as for the image forming portions Pb to Pd, descriptions thereof are omitted since they basically have similar configurations to that of the image forming portion Pa. As shown in FIG. 2, around the photosensitive drum 1*a*, the charging device 2*a*, the developing device 3*a*, and the cleaning device 7*a* are provided along a drum rotation direction (a clockwise direction in FIG. 2), and the primary transfer roller 6*a* is disposed opposite the photosensitive drum 1*a* via the intermediate transfer belt 8. Furthermore, on an upstream side in a rotation direction of the intermediate transfer belt 8 with respect to the photosensitive drum 1*a*, the belt cleaning unit 19 is disposed to be opposed to a tension roller 11 via the intermediate transfer belt 8.

The charging device 2*a* includes the charging roller 21 that makes contact with the photosensitive drum 1*a* so as to apply a charging bias to a drum surface thereof and a charging cleaning roller 23 for cleaning the charging roller 21.

The developing device 3*a*, includes two stirring conveyance members 24 composed of a stirring conveyance screw and a supply conveyance screw and the developing roller 25, and toner carried on a surface of the developing roller 25 is caused to fly onto the surface of the photosensitive drum 1*a* so as to be used to develop the electrostatic latent image into a toner image.

The cleaning device 7*a* includes a rubbing roller 26 and a cleaning blade 28 that make contact with the surface of the photosensitive drum 1*a* so as to remove residual toner or the like remaining on the surface of the photosensitive drum 1*a* and a collection spiral 29 that discharges the toner or the like removed by the rubbing roller 26 and the cleaning blade 28 to an exterior.

Furthermore, the photosensitive drum 1*a*, the charging device 2*a*, and the cleaning device 7*a* are integrated as a unit. In each of the image forming portions Pa to Pd, a corresponding one of the photosensitive drums 1*a* to 1*d*, a corresponding one of the charging devices 2*a* to 2*d*, and a corresponding one of the cleaning devices 7*a* to 7*d* form a unit, and such units formed in the image forming portions Pa to Pd, respectively, are hereinafter referred to as drum units (image carrier units) 40*a* to 40*d*.

Figure 3:
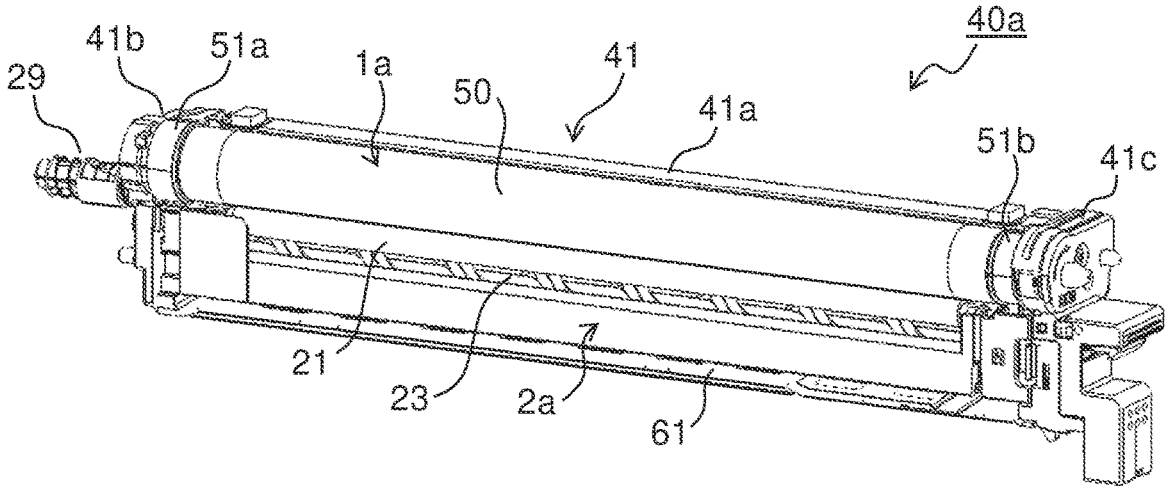
FIG. 3 is a perspective view, as seen from a photosensitive drum side, of a drum unit according to an embodiment of the present disclosure.
Figure 4:
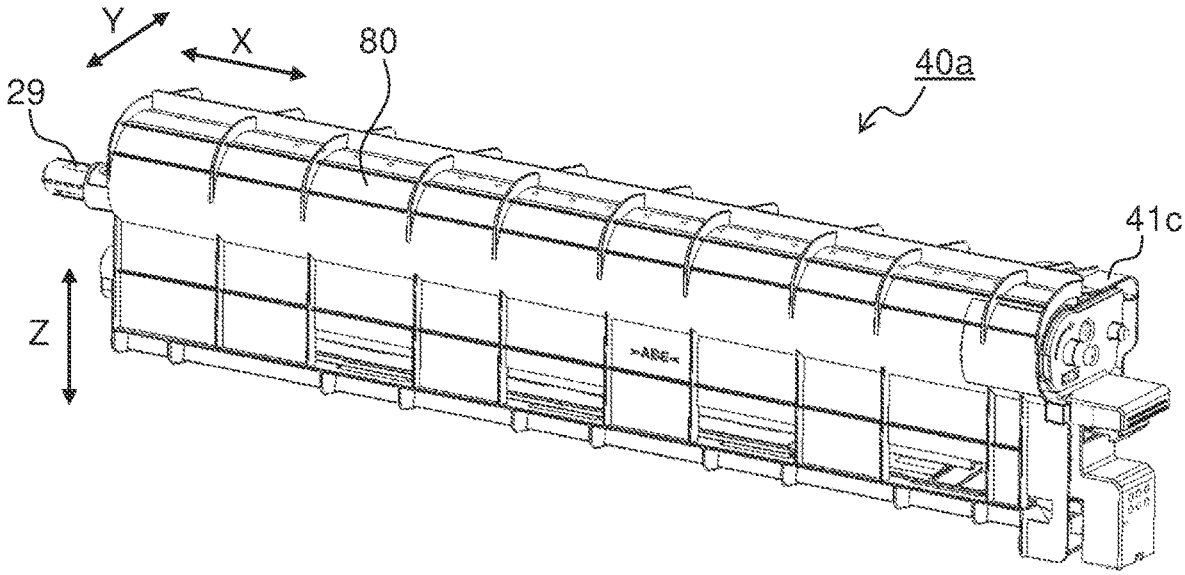
FIG. 4 is a perspective view showing a state where a drum protective cover is mounted to the drum unit of the embodiment.
Figure 5:
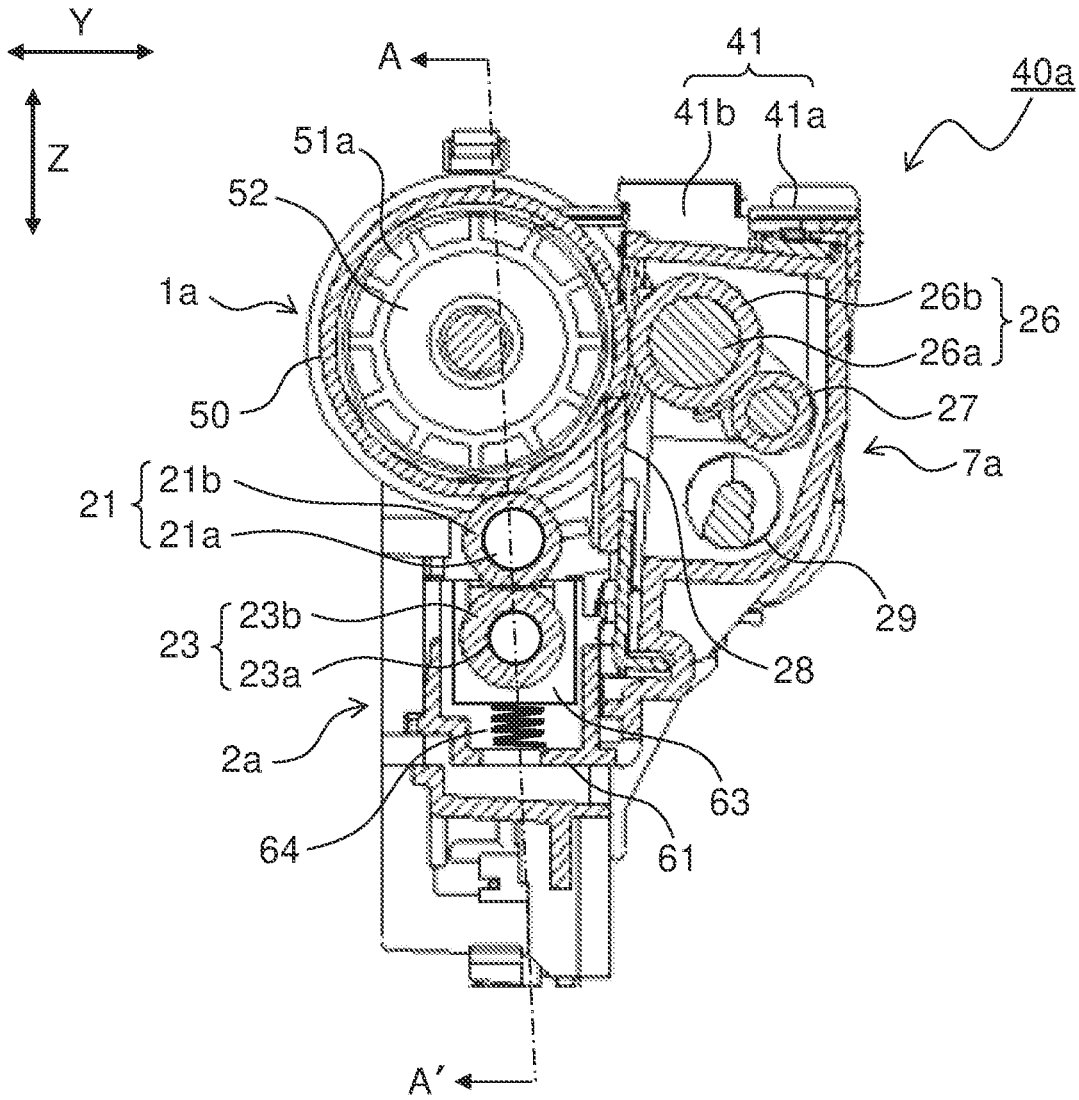
FIG. 5 is a side sectional view of the drum unit of the embodiment.
Figure 6:
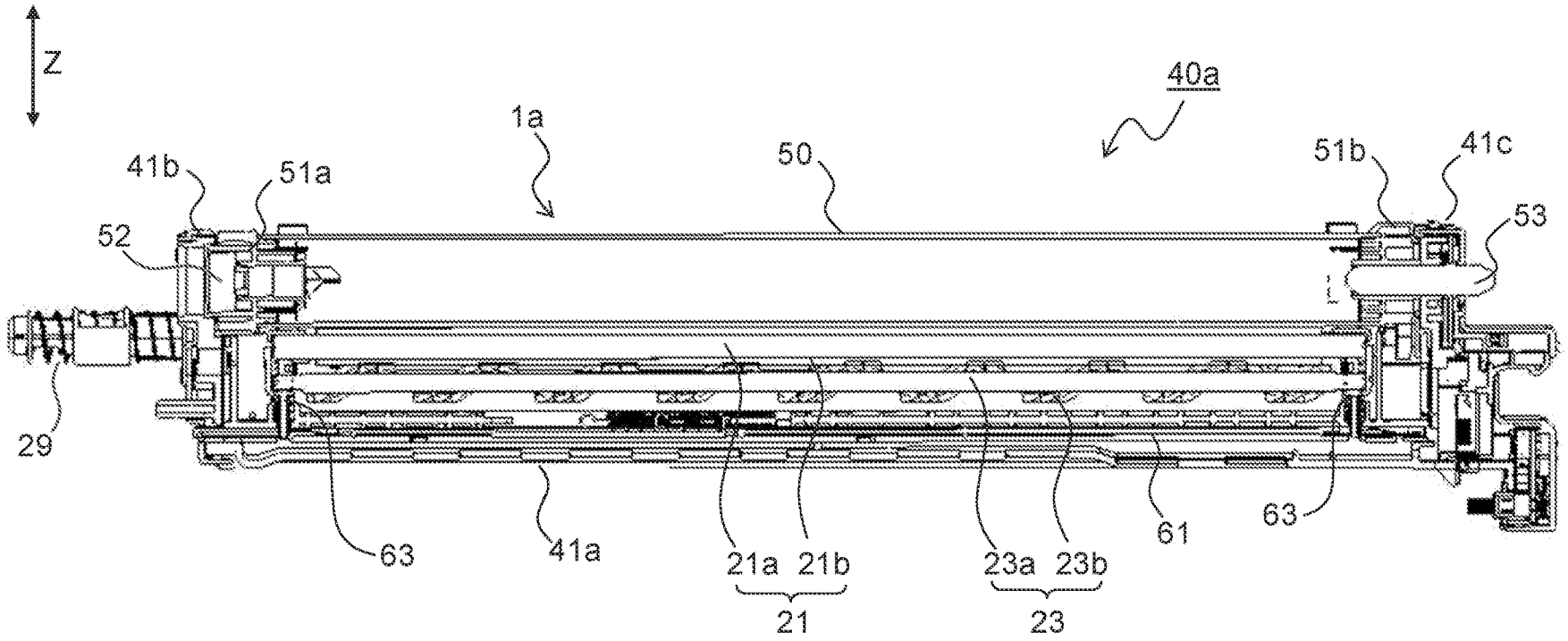
FIG. 6 is a longitudinal sectional view of the drum unit of the embodiment cut along an axial direction thereof.

Next, a description is given of the drum unit 40*a* used in the image forming apparatus 100. FIG. 3 is a perspective view of the drum unit 40*a* as seen from a side near the photosensitive drum 1*a* (a left side in FIG. 2). FIG. 4 is a perspective view showing a state where a drum protective cover 80 is mounted to the drum unit 40*a* in FIG. 3. FIG. 5 is a side sectional view of the drum unit 40*a*. FIG. 6 is a longitudinal sectional view (a sectional view taken in a direction of arrows A-A' in FIG. 5) of the drum unit 40*a* cut along an axial direction thereof.

As for the drum units 40*b* to 40*d*, descriptions thereof are omitted since they have similar configurations to that of the drum unit 40*a*. Furthermore, in the drawings referenced hereinafter, a longitudinal direction of the drum unit 40*a* (an axial direction of the photosensitive drum 1*a*) is referred to as an X direction, a width direction of the drum unit 40*a* orthogonal to the X direction is referred to as a Y direction, and a perpendicular direction orthogonal to the X direction and to the Y direction is referred to as a Z direction.

As shown in FIG. 3 and FIG. 5, the drum unit 40*a* includes the photosensitive drum 1*a*, the charging device 2*a*, the cleaning device 7*a*, and a unit frame 41. The unit frame 41 includes a main body frame 41*a* extending along a longitudinal direction (X direction) of the photosensitive drum 1*a* and support frames 41*b* and 41*c* that are attached to both end parts of the main body frame 41*a* so as to be opposed to both end parts of the photosensitive drum 1*a* in the longitudinal direction.

The drum unit 40*a* is a consumable article subject to periodic replacement and thus is packaged, shipped, and stored alone. For this reason, as shown in FIG. 4, the drum unit 40*a* is packaged in a state where the drum protective cover (image carrier protective cover) 80 is mounted thereto so as to protect the surface of the photosensitive drum 1*a* when the drum unit 40*a* is packaged, shipped, and stored. A detailed configuration of the drum protective cover 80 will be described later.

As shown in FIG. 5 and FIG. 6, the photosensitive drum 1*a* is composed of a cylindrical drum main body 50 having a photosensitive layer formed on an outer circumferential surface thereof and flange portions 51*a* and 51*b* attached to both end parts of the drum main body 50.

In the drum unit 40*a* alone, an end part (flange portion 51*a*) of the photosensitive drum 1*a* on a side near the support frame 41*b* is not radially positioned and is swingable in a prescribed range. When the drum unit 40*a* is mounted in the main body of the image forming apparatus 100, the flange portion 51*a* is fitted to a main-body-side coupling (not shown), and thus positioning of the end part is achieved. Furthermore, when the drum protective cover 80 is mounted to the drum unit 40*a*, a drum holding portion 83 (see FIG. 10) of the drum protective cover 80 is inserted into a flange positioning hole 52 of the flange portion 51*a*, and thus positioning of the end part with respect to the support frame 41*b* is achieved. As for the other end part (flange portion 51*b*) of the photosensitive drum 1*a* on a side near the support frame 41*c*, a drum rotary shaft 53 secured to a center of the flange portion 51*b* is rotatably supported to the support frame 41*c*, and thus positioning of the other end part is achieved.

The cleaning device 7*a* includes the rubbing roller (first cleaning member) 26, a toner regulation roller 27, the cleaning blade 28, and the collection spiral 29. The rubbing roller 26 is biased into pressure contact under a prescribed pressure with the photosensitive drum 1*a* by a first coil spring 30 (see FIG. 12) and is driven to rotate, by a drum cleaning motor (not shown), in the same direction as a rotation direction of the photosensitive drum 1*a* on its surface of contact with the photosensitive drum 1*a* at a linear velocity higher than (herein, 1.2 times) that of the photosensitive drum 1*a*.

The rubbing roller 26 is rotated with a difference in velocity from the photosensitive drum 1*a* so that the surface of the photosensitive drum 1*a* is ground by use of residual toner containing an abrasive. The rubbing roller 26 and the cleaning blade 28 remove, together with the residual toner, moisture, a discharge product, and so on adhering to the surface of the photosensitive drum 1*a*.

The rubbing roller 26 has, for example, a structure in which a roller body 26*b* that is a foam layer made of an EPDM rubber and having an Asker C hardness of 55° is formed around a metallic rotary shaft 26*a*. The roller body 26*b* may be made of a material, without being limited to an EPDM rubber, such as any other type of rubber or a foamed rubber body, and such a material having an Asker C hardness in a range of 10° to 90° is used favorably.

The toner regulation roller 27 is disposed in contact under a prescribed pressure with the rubbing roller 26 and regulates an amount of toner adhering to a surface of the rubbing roller 26 so as to adjust a grinding amount of the surface of the photosensitive drum 1*a*.

The cleaning blade 28 is secured in contact with the surface of the photosensitive drum 1*a* at a location on an upstream side, in the rotation direction, of a position of contact with the charging roller 21. The cleaning blade 28 is formed of, for example, a blade made of a polyurethane rubber and having a JIS hardness of 78° and is mounted at a prescribed angle on its point of contact with respect to a tangential direction of the photosensitive drum 1*a*.

The collection spiral 29 conveys residual toner removed from the surface of the photosensitive drum 1*a* by the rubbing roller 26 and the cleaning blade 28. As shown in FIG. 6, the collection spiral 29 extends to an exterior of the unit frame 41 and discharges residual toner to an exterior of the cleaning device 7*a* as it rotates.

The charging device 2*a* includes the charging roller (charging member) 21, the charging cleaning roller (second cleaning member) 23, and a charging housing 61. The charging device 2*a* is mountable/demountable with respect to the unit frame 41. The charging housing 61 is formed using a nonconductive resin so as to extend in an axial direction of the charging roller 21 and houses the charging roller 21 and the charging cleaning roller 23. The charging roller 21 is a conductive rubber roller composed of a metallic rotary shaft (first rotary shaft) 21*a* and an elastic layer 21*b* made of rubber and formed on an outer circumferential surface of the rotary shaft 21*a*. The charging roller 21 is brought into pressure contact under a prescribed nip pressure with the photosensitive drum 1*a* and thus rotates passively following rotation of the photosensitive drum 1*a*.

The charging cleaning roller 23 is composed of a rotary shaft (second rotary shaft) 23*a* and a cleaning portion 23*b* formed of a sponge-like elastic member and spirally wound on an outer circumferential surface of the rotary shaft 23*a*. The charging cleaning roller 23 is rotated in a state where the cleaning portion 23*b* is in contact with an outer circumferential surface of the charging roller 21, thus removing residual toner, paper dust, and so on adhering to the charging roller 21. A drive input gear (not shown) for transmitting a rotation drive force to the charging cleaning roller 23 is secured to an end part of the rotary shaft 23*a* of the charging cleaning roller 23 on the side near the support frame 41*c*.

On both end part sides of the charging roller 21 and the charging cleaning roller 23 in axial directions thereof, a pair of bearing members 63 is disposed to rotatably support the rotary shaft 21*a* of the charging roller 21 and the rotary shaft 23*a* of the charging cleaning roller 23. The bearing members 63 are made of a conductive resin.

A second coil spring 64 is disposed between the charging housing 61 and each of the bearing members 63. An upper end part and a lower end part of the second coil spring 64 are in contact with a lower part of the each of the bearing members 63 and a bottom surface of the charging housing 61, respectively. The second coil spring 64 biases the charging roller 21 toward the photosensitive drum 1*a* (upward) via the each of the bearing members 63. Under a biasing force of the second coil spring 64, the charging roller 21 is evenly brought into pressure contact with the surface of the photosensitive drum 1*a* and thus rotates passively following rotation of the photosensitive drum 1*a*.

Figure 7:
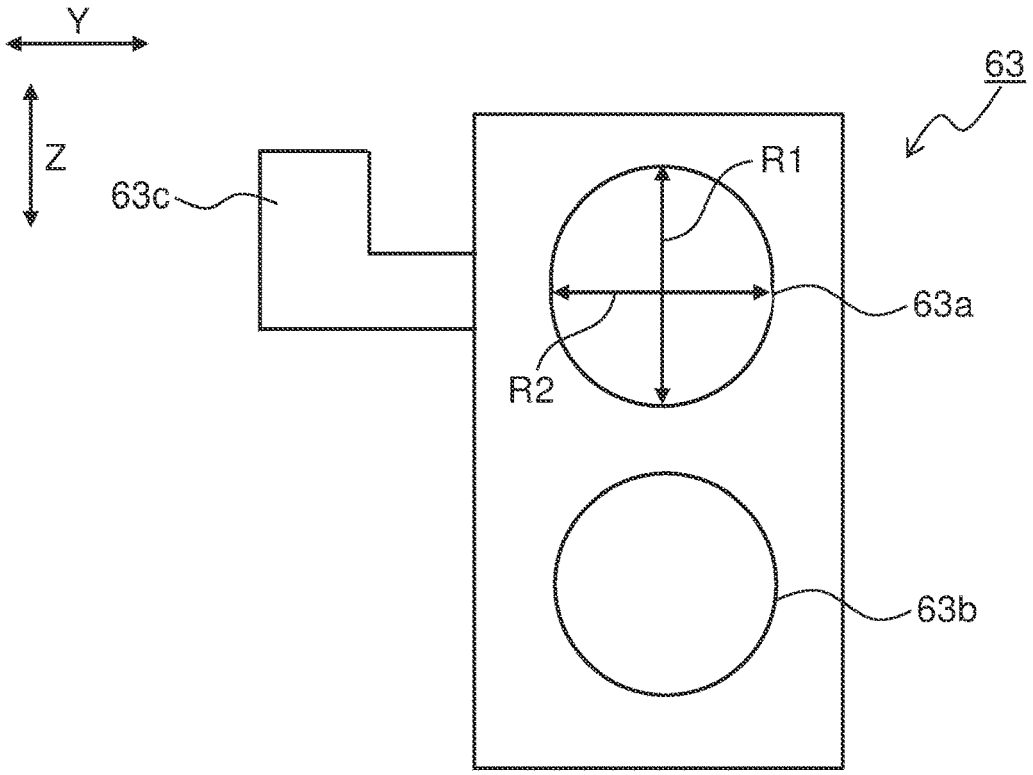
FIG. 7 is a front view of a bearing member used in the drum unit of the embodiment.
Figure 8:
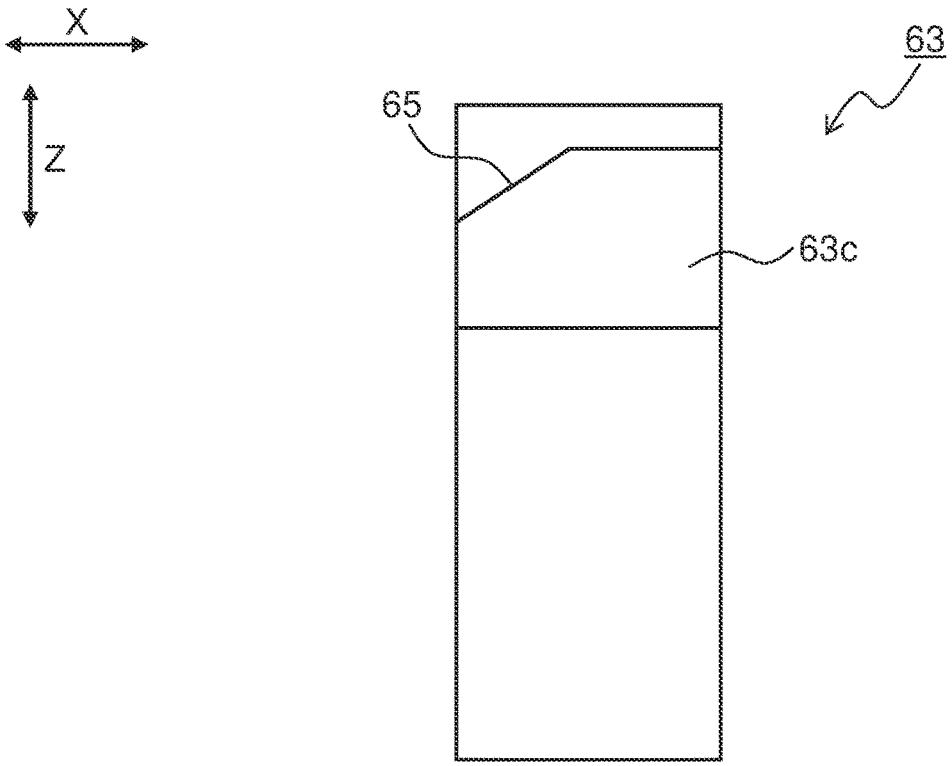
FIG. 8 is a side view of the bearing member as seen from a pressed portion side.

FIG. 7 is a front view of a bearing member 63 as one of the pair of bearing members 63. FIG. 8 is a side view of the bearing member 63 as seen from a side near a pressed portion 63*c*. While FIG. 7 and FIG. 8 show a configuration of the one of the pair of bearing members 63 on one end side of the drum unit 40*a* (a left side in FIG. 6), the other bearing member 63 on the other end side of the drum unit 40*a* (a right side in FIG. 6) also has the same structure as that of the one of the pair of bearing members 63 except that they are in bilateral symmetry.

As shown in FIG. 7, in the bearing member 63, a first bearing portion 63*a* that rotatably supports the rotary shaft 21*a* of the charging roller 21 and a second bearing portion 63*b* that rotatably supports the rotary shaft 23*a* of the charging cleaning roller 23 are formed integrally with each other. The first hearing portion 63*a* has an inner diameter defined by such an elongated hole shape that an inner diameter R1 in an approaching/separating direction (an up-down direction in FIG. 7) to/from each of the photosensitive drums 1*a* to 1*d* is longer than an inner diameter R2 in a direction (a left-right direction in FIG. 7) orthogonal to the approaching/separating direction. The inner diameter R2 is substantially equal to an outer diameter of the rotary shaft 21*a*. This makes it possible for the rotary shaft 21*a* to move in the approaching/separating direction within a range of the inner diameter R1. The second bearing portion 63*b*, on the other hand, has an inner diameter substantially equal to an outer diameter of the rotary shaft 23*a* of the charging cleaning roller 23.

Furthermore, on a side surface of the bearing member 63, there is formed the pressed portion 63*c* that is to be contacted by a pressure release rib 85 (see FIG. 9) of the drum protective cover 80. The pressed portion 63*c* has an inclined surface 65 firmed therein to have an upward inclination from outside to inside the support frame 41*b*, more specifically, toward a downstream side in a mounting direction of the drum protective cover 80 (from a left side to a right side in FIG. 8).

Figure 9:
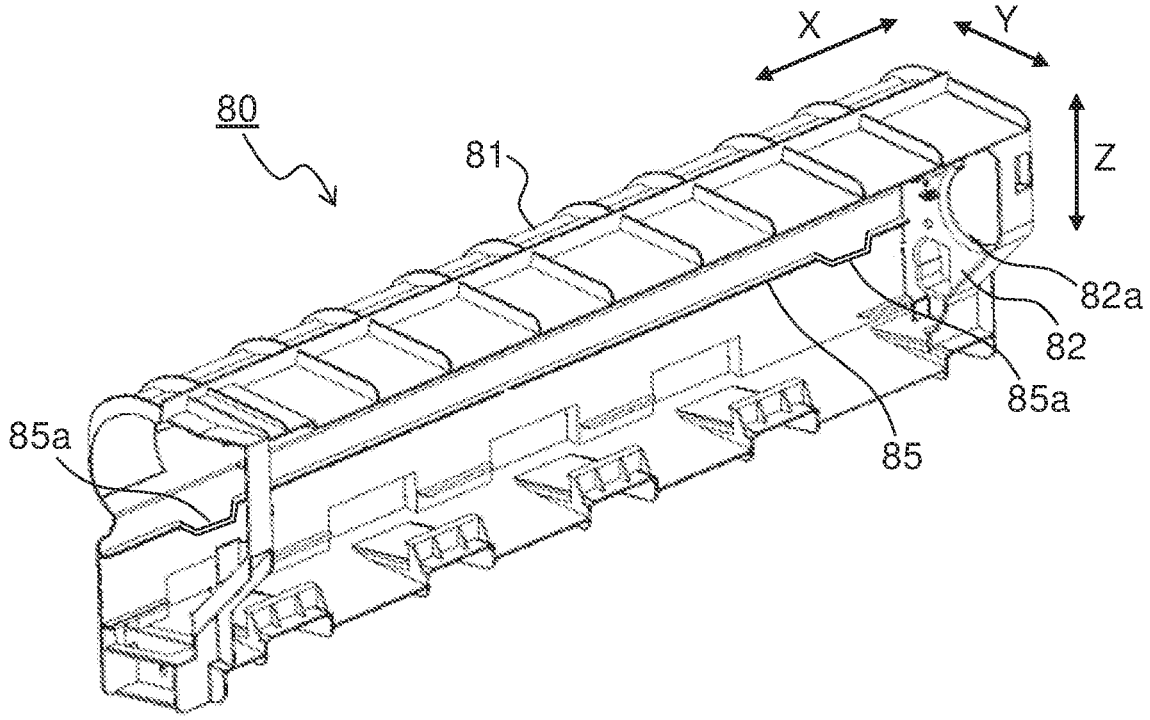
FIG. 9 is a perspective view, as seen from an inner side, of the drum protective cover that is mounted to the drum unit of the embodiment.
Figure 10:
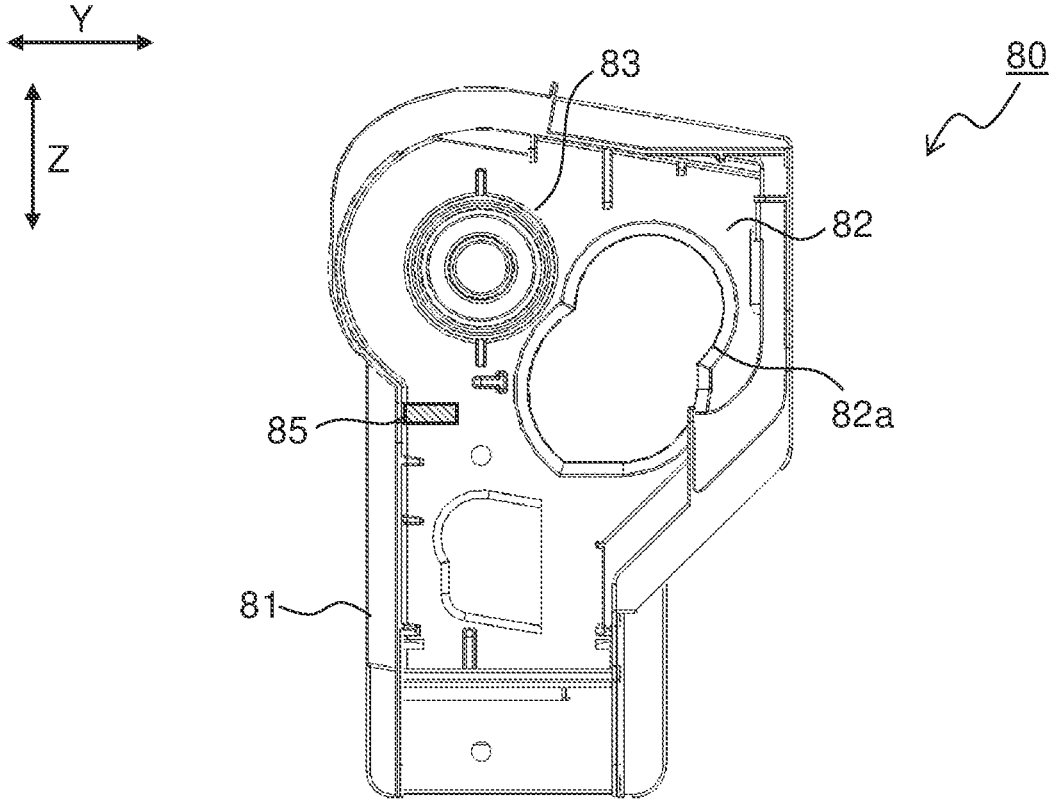
FIG. 10 is a front view of a side surface portion of the drum protective cover as seen from an inner side.

FIG. 9 is a perspective view of the drum protective cover 80 as seen from an inner side. FIG. 10 is a front view of a side surface portion 82 of the drum protective cover 80 as seen from an inner side. The drum protective cover 80 includes a cover main body 81 that extends in the axial direction of the photosensitive drum 1*a* and protects the photosensitive drum 1*a* and the side surface portion 82 that is disposed on one end side of the cover main body 81 (the side near the support frame 41*b*).

The drum holding portion 83 is formed on an inner side of the side surface portion 82 of the drum protective cover 80. The drum holding portion 83 performs positioning of the flange portion 51*a* with respect to the support frame 41*b* in a state where the drum protective cover 80 is mounted to the drum unit 40*a* and releases a pressure contact state between the photosensitive drum 1*a* and the rubbing roller 26. Furthermore, the side surface portion 82 has an opening hole 82*a* formed therethrough for allowing the collection spiral 29 (see FIG. 6) of the cleaning device 7*a* to protrude therefrom.

The pressure release rib 85 is formed on an inner side of the cover main body 81 of the drum protective cover 80. The pressure release rib 85 extends over substantially an entire region of the cover main body 81 along the axial direction of the photosensitive drum 1*a*. At each of two locations on the pressure release rib 85 along an extending direction thereof, a pressing convex portion 85*a* is formed at a position to be opposed to the pressed portion 63*c* of the hearing member 63. In a state where the drum protective cover 80 is mounted to the drum unit 40*a*, the pressure release rib 85 releases a pressure contact state between the photosensitive drum 1*a* and the charging roller 21.

Figure 11:
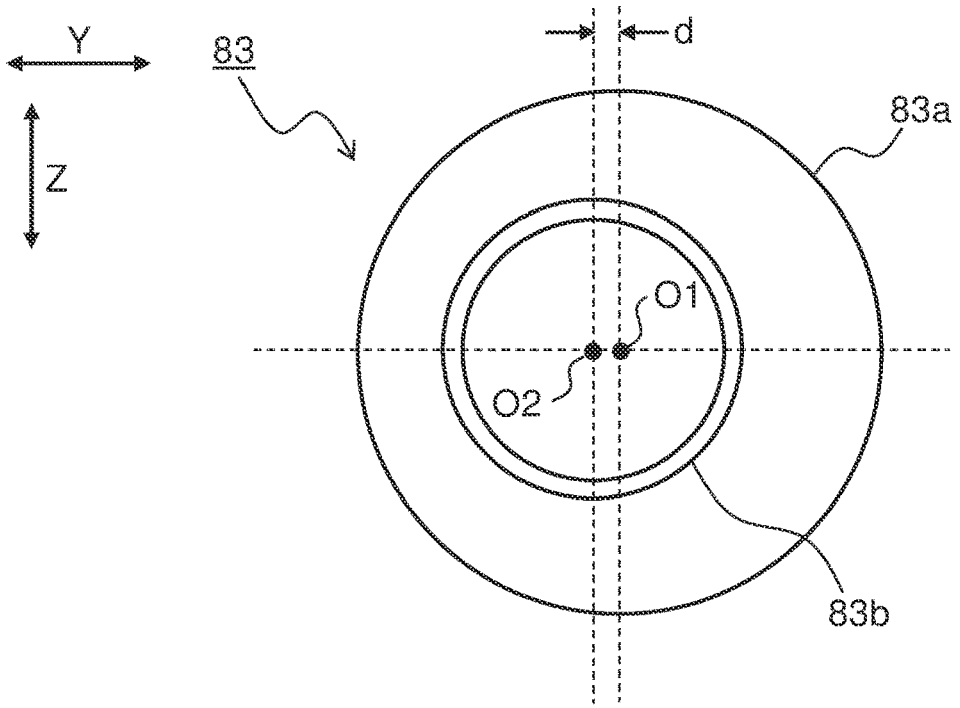
FIG. 11 is an enlarged view of a drum holding portion of the drum protective cover.

Next, a description is given of a mechanism for releasing a pressure contact state between the photosensitive drum 1*a* and the rubbing roller 26 by mounting the drum protective cover 80. FIG. 11 is an enlarged view of the drum holding portion 83 of the drum protective cover 80. The drum holding portion 83 includes a frame positioning boss (first positioning boss) 83*a* and a flange positioning boss (second positioning boss) 83*b*.

The frame positioning boss 83*a* cylindrically protrudes from an inner surface of the side surface portion 82. The frame positioning boss 83*a* fits in a cover positioning hole (first positioning hole) 42 (see FIG. 12) of the support frame 41*b*, thereby performing positioning between the drum protective cover 80 and the support frame 41*b*.

The flange positioning boss 83*b* cylindrically protrudes from a distal end surface of the frame positioning boss 83*a*. The flange positioning boss 83*b* fits in the flange positioning hole (second positioning hole) 52 (see FIG. 12) of the flange portion 51*a*, thereby performing positioning between the drum protective cover 80 and the flange portion 51*a*.

As shown in FIG. 11, the flange positioning boss 83*b* has an outer diameter smaller than an outer diameter of the frame positioning boss 83*a*. Furthermore, a center axis O1 of the frame positioning boss 83*a* is displaced from a center axis O2 of the flange positioning boss 83*b* by a distance d in the Y direction. More specifically, the center axis O2 of the flange positioning boss 83*b* is displaced in such a direction (leftward in FIG. 11) so as to be separated from the rubbing roller 26 relative to the center axis O1 of the frame positioning boss 83*a*.

Figure 12:
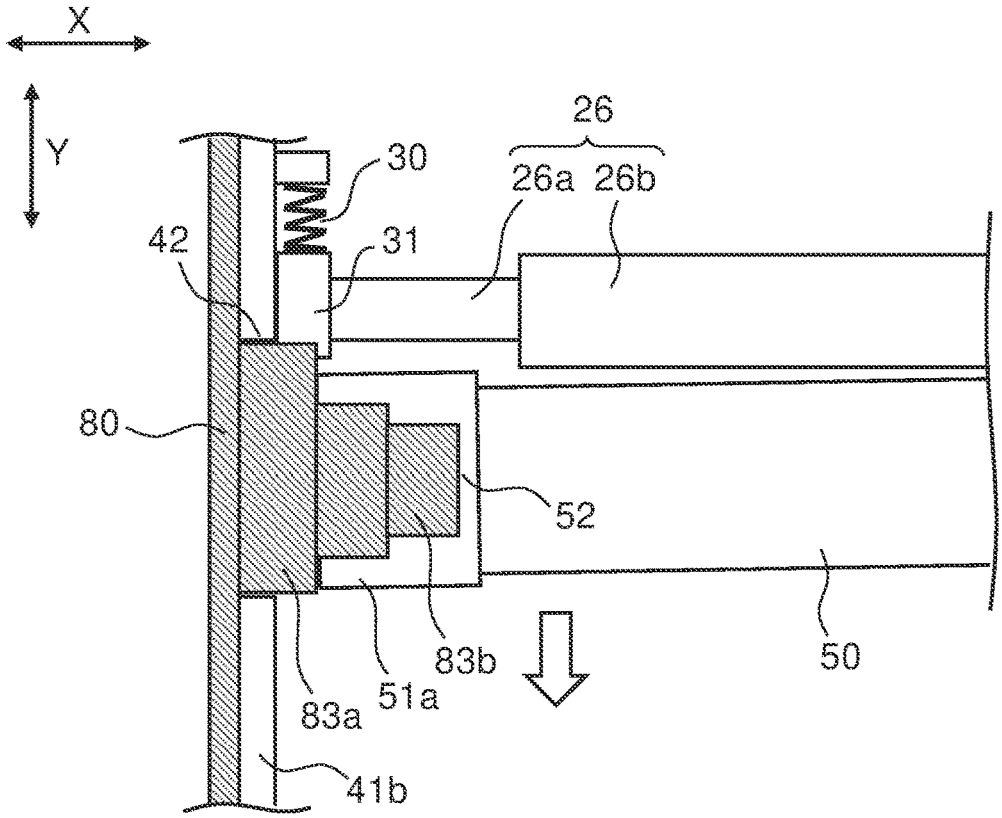
FIG. 12 is a schematic view showing a state where a flange positioning boss of the drum holding portion is inserted into a positioning hole of a flange portion, so that a drum main body is separated from a rubbing roller.

FIG. 12 is a schematic view showing a state where the flange positioning boss 83*b* of the drum holding portion 83 is inserted into the positioning hole 52 of the flange portion 51*a*. When the drum protective cover 80 is slid in the X direction, the frame positioning boss 83*a* of the drum holding portion 83, which is formed on the side surface portion 82, is inserted into the cover positioning hole 42 of the support frame 41*b*. Furthermore, the flange positioning boss 83*b* is inserted into the flange positioning hole 52 of the flange portion 51*a*.

This achieves positioning between the drum protective cover 80 and the support frame 41*b* and between the drum protective cover 80 and the photosensitive drum 1*a*, thus achieving positioning between the photosensitive drum 1*a* and the support frame 41*b*.

Here, the flange positioning boss 83*b* is displaced in such a direction (downward in FIG. 12) as to be separated from the rubbing roller 26 relative to the frame positioning boss 83*a*. Because of this, as shown in FIG. 12, the flange portion 51*a* is positioned at a position more distant from the rubbing roller 26 than a position thereof when the drum unit 40*a* is mounted in the image forming apparatus 100 (hereinafter, referred to as a reference position). As a result, the photosensitive drum 1*a* is held in a state where a part thereof on a side near the flange portion 51*a* is inclined in a separating direction from the rubbing roller 26.

A bearing portion 31 that rotatably supports the rotary shaft 26*a* of the rubbing roller 26, on the other hand, is supported so as to be movable in the Y direction relative to the support frame 41*b* and is biased in a direction (downward in FIG. 12) toward the photosensitive drum 1*a* by the first coil spring 30. With this in view, a displacement amount d of the flange positioning boss 83*b* relative to the frame positioning boss 83*a* is preset to be larger than a movable distance of the bearing portion 31 from a reference position thereof, and thus the part of the photosensitive drum 1*a* on the side near the flange portion 51*a* can be separated from the rubbing roller 26.

Since the drum rotary shaft 53 is supported to the support frame 41*c*, a distance between a part of the photosensitive drum 1*a* on a side near the flange portion 51*b* (the right side in FIG. 6) and the rubbing roller 26 does not vary. Nevertheless, with the part of the photosensitive drum 1*a* on the side near the flange portion 51*a* being separated from the rubbing roller 26, a pressure contact state of the rubbing roller 26 with the drum main body 50 is released, and thus it is possible to effectively suppress permanent deformation of the rubbing roller 26.

Figure 13:
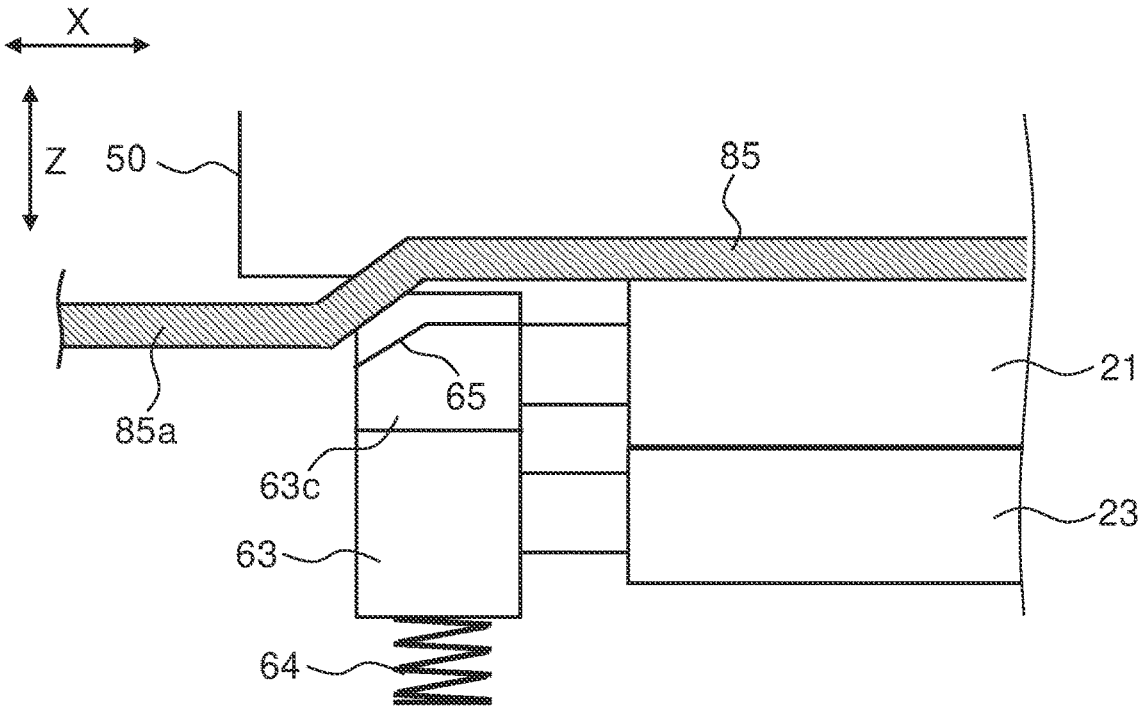
FIG. 13 is a schematic view showing a state immediately before a pressing convex portion of a pressure release rib makes contact with a pressed portion of the bearing member.

Next, a description is given of a mechanism for releasing a pressure contact state between the photosensitive drum 1*a* and the charging roller 21 by mounting the drum protective cover 80. FIG. 13 is a schematic view showing a state immediately before the pressing convex portion 85*a* of the pressure release rib 85 makes contact with the pressed portion 63*c* of the bearing member 63.

In mounting the drum protective cover 80, first, the cover main body 81 is disposed to be opposed to the photosensitive drum 1*a*. Next, the drum protective cover 80 is slid gradually along the axial direction of the photosensitive drum 1*a* from the side near the flange portion 51*a* to the side near the flange portion 51*b*. Thus, as shown in FIG. 13, the pressing convex portion 85*a* of the pressure release rib 85 formed on the inner side of the cover main body 81 approaches the pressed portion 63*c* of the bearing member 63.

When the drum protective cover 80 is slid further from a state shown in FIG. 13, the pressing convex portion 85*a* of the pressure release rib 85 rides on the inclined surface 65 formed on the pressed portion 63*c* of the bearing member 63.

Figure 14:
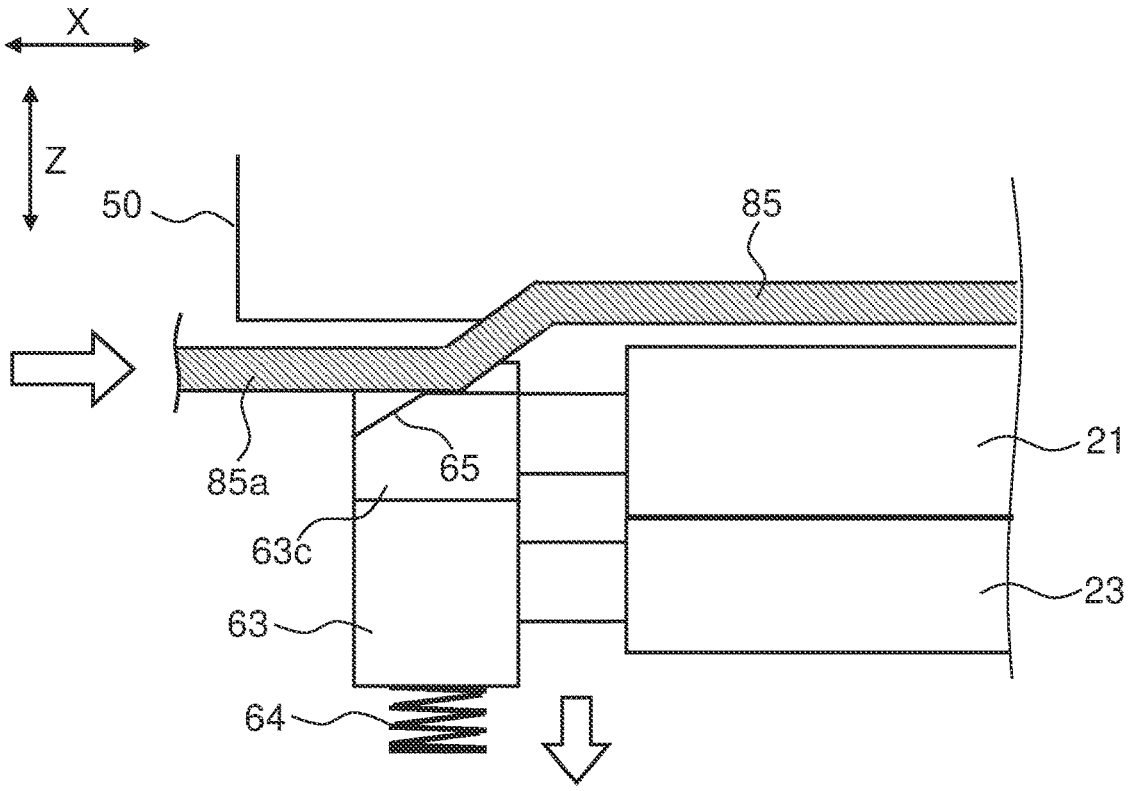
FIG. 14 is a schematic view showing a state where the pressing convex portion of the pressure release rib has made contact with the pressed portion of the bearing member, so that the drum main body is separated from a charging roller.

FIG. 14 is a schematic view showing a state where the pressing convex portion 85*a* of the pressure release rib 85 has made contact with the pressed portion 63*c* of the bearing member 63, so that the drum main body 50 is separated from the charging roller 21. As shown in FIG. 14, the pressing convex portion 85*a* is inserted between the drum main body 50 and the bearing member 63 while pressing down the pressed portion 63*c*, and thus the drum main body 50 is separated from the charging roller 21.

By the above-described separating operation, the charging roller 21 is brought into a state free from a pressure from the photosensitive drum 1*a*, which is a reaction to (resistance against) a pressing force of the second coil spring 64, namely, a pressing force in a separating direction from the photosensitive drum 1*a* in the approaching/separating direction. At this time, the charging roller 21 is brought into a state of being separated from a part of an inner circumferential surface (a lower surface in FIG. 7) of the first bearing portion 63*a* on a lower side (a side closer to the charging cleaning roller 23) and placed on a surface of the charging cleaning roller 23. That is, only a weight of the charging roller 21 acts on the charging cleaning roller 23, with no biasing force of the second coil spring 64 acting thereon.

Thus, it is possible to suppress a phenomenon in which the cleaning portion 23*b* of the charging cleaning roller 23 is deformed and remains in that state. This makes it possible to suppress deterioration in cleaning performance of the charging cleaning roller 23 and unstable passive rotation of the charging roller 21 due to friction of the cleaning portion 23*b*. While the description herein is of an operation in which the pressure release rib 85 presses down one of the hearing members 63 on one side (the left side in FIG. 6), the other bearing member 63 on the other side (the right side in FIG. 6) is also pressed down simultaneously by the pressure release rib 85.

In this embodiment, the drum protective cover 80 includes the drum holding portion 83 formed therein to perform positioning of a part of each of the photosensitive drums 1*a* to 1*d* on the side near the flange portion 51*a*. Furthermore, the flange positioning boss 83*b* of the drum holding portion 83 is provided so as to be displaced in the separating direction from the rubbing roller 26 relative to the frame positioning boss 83*a*. Thus, when the drum protective cover 80 is mounted to each of the drum units 40*a* to 40*d*, a corresponding one of the photosensitive drums 1*a* to 1*d* is held in a state where a part thereof on the side near the flange portion 51*a* is inclined in the separating direction from the rubbing roller 26, and thus it is possible to release a pressure contact state between the corresponding one of the photosensitive drums 1*a* to 1*d* and the rubbing roller 26.

Accordingly, even in a case where the drum units 40*a* to 40*d* are stored for a long period of time, it is possible to suppress permanent deformation of the rubbing roller 26. As a result, it is possible to effectively suppress adhesion of a discharge product to the photosensitive drums 1*a* to 1*d* due to deterioration in rubbing performance or cleaning performance and adhesion of a toner external additive or the like to the charging roller 21.

Furthermore, in this embodiment, the drum protective cover 80 is provided with the pressure release rib 85 that separates each of the photosensitive drums 1*a* to 1*d* from the charging roller 21. Thus, when the drum protective cover 80 is mounted to each of the drum units 40*a* to 40*d*, the pressure release rib 85 presses down the pressed portion 63*c* of the bearing member 63, thereby enabling the each of the photosensitive drums 1*a* to 1*d* to be separated from the charging roller 21.

Accordingly, even in a case where the drum units 40*a* to 40*d* are stored for a long period of time, it is possible to suppress permanent deformation of the charging roller 21. As a result, it is possible to effectively suppress deterioration in charging performance and occurrence of a phenomenon (bleeding phenomenon) in which a rubber component of the charging roller 21 adheres to the respective surfaces of the photosensitive drums 1*a* to 1*d*.

Furthermore, when the drum protective cover 80 is demounted from each of the drum units 40*a* to 40*d*, the drum holding portion 83 is pulled out from the flange portion 51*a*, and when the drum units 40*a* to 40*d* are mounted in the main body of the image forming apparatus 100, each of the photosensitive drums 1*a* to 1*d* is brought into pressure contact with the rubbing roller 26. Furthermore, when the drum protective cover 80 is demounted, the pressure release rib 85 is separated from the pressed portion 63*c*, and thus each of the photosensitive drums 1*a* to 1*d* is brought into pressure contact with the charging roller 21.

As described above, by performing an operation of mounting/demounting the drum protective cover 80 to/from each of the drum units 40*a* to 40*d*, it is possible to bring into contact or separate a corresponding one of the photosensitive drums 1*a* to 1*d* with or from the charging roller 21 and the rubbing roller 26. Accordingly, it is possible to improve workability of replacing the drum units 40*a* to 40*d* while suppressing an increase in number of components used or a size increase.

Furthermore, the first bearing portion 63*a* of the bearing member 63, which supports the rotary shaft 21*a* of the charging roller 21, has such an elongated hole shape that the inner diameter R1 in the approaching/separating direction is longer than the inner diameter R2 in the direction orthogonal to the approaching/separating direction. Thus, when a pressure contact state between the photosensitive drum 1*a* and the charging roller 21 is released, the charging roller 21 is brought into a state free from a pressing force in the separating direction from the photosensitive drum 1*a*, positioned on an upper side in the first bearing portion 63*a*, and placed on the surface of the charging cleaning roller 23. Accordingly, it is possible to suppress deformation of the charging roller 21 caused by the charging cleaning roller 23 and deformation of the cleaning portion 23*b* of the charging cleaning roller 23 during transportation and storage of the drum units 40*a* to 40*d*.

Other than the above, the present disclosure is not limited to the foregoing embodiment and can be variously modified without departing from the spirit of the disclosure. For example, while the foregoing embodiment uses the charging cleaning roller 23 composed of the rotary shaft 23*a* and the cleaning portion 23*b* spirally wound on the outer circumferential surface of the rotary shaft 23*a*, a cleaning brush may be used in place of the charging cleaning roller 23.

Furthermore, regarding the bearing member 63, the drum protective cover 80, the drum holding portion 83, and the pressure release rib 85, their respective shapes and so on described above are also preferred examples and can be changed as appropriate depending on specifications or the like of the charging devices 2*a* to 2*d* or the drum units 40*a* to 40*d*.

Furthermore, while the foregoing embodiment has described an example in which the present disclosure is applied to the drum units 40*a* to 40*d* mounted in a color printer, the present disclosure is not limited thereto. Needless to say, the present disclosure is applicable in a completely similar manner also to a drum unit mounted in a monochrome printer, a color copy machine, a monochrome copy machine, a digital multi-functional peripheral, a facsimile, or the like.

The present disclosure is usable in an image carrier unit including an image carrier, a cleaning member that makes contact with the image carrier so as to clean a surface of the image carrier, and a demountable image carrier protective cover that protects the image carrier. By use of the present disclosure, it is possible to provide an image carrier unit that is capable of maintaining a state where a cleaning member is separated from an image carrier while suppressing an increase in number of components used and a size increase.

What is claimed is:

1. An image carrier unit that is mountable/demountable with respect to a main body of an image forming apparatus, the image carrier unit comprising:

an image carrier that includes a cylindrical main body portion and a pair of flange portions attached to both ends of the main body portion, a toner image being formed on a surface of the main body portion;

a first cleaning member that rotates in contact under a prescribed pressure with an outer circumferential surface of the main body portion so as to remove residual toner remaining on the surface of the main body portion;

a unit frame that rotatably supports the image carrier and the first cleaning member; and an image carrier protective cover that is mountable/demountable with respect to the unit frame and protects the image carrier, wherein the image carrier protective cover includes:

a cover main body that extends in an axial direction of the image carrier and protects the image carrier; and a side surface portion that is disposed on one end side of the cover main body, on the side surface portion, an image carrier holding portion is formed that is inserted into one of the pair of flange portions and performs positioning of the image carrier with respect to the unit frame, and while performing the positioning of the image carrier, the image carrier holding portion releases a pressure contact state between the image carrier and the first cleaning member.

2. The image carrier unit according to claim 1, wherein the image carrier holding portion includes:

a first positioning boss that protrudes inwardly from the side surface portion and fits in a first positioning hole of the unit frame; and a second positioning boss that protrudes inwardly from a distal end of the first positioning boss, fits in a second positioning hole of the one of the pair of flange portions, and has a diameter smaller than a diameter of the first positioning boss, and a center axis of the second positioning boss is displaced in a separating direction from the first cleaning member relative to a center axis of the first positioning boss.

3. The image carrier unit according to claim 2, wherein the first cleaning member is supported so as to be movable in an approaching/separating direction to/from the image carrier relative to the unit frame and is biased in an approaching direction to the image carrier by a first biasing member, and a displacement amount of the second positioning boss relative to the first positioning boss is larger than a movable distance of the first cleaning member from a reference position thereof when the image carrier unit is mounted in the main body of the image forming apparatus.

4. The image carrier unit according to claim 1, further comprising:

a charging device including:

a charging member that rotates in contact under a prescribed pressure with an outer circumferential surface of the image carrier so as to charge the image carrier;

a pair of bearing members, each of which includes a first bearing portion for rotatably supporting each of both end parts of a first rotary shaft of the charging member and is reciprocatable in an approaching/separating direction to/from the image carrier; and a second biasing member that biases each of the pair of bearing members in an approaching direction to the image carrier, wherein the image carrier protective cover includes a pressure release rib that moves each of the pair of bearing members in a separating direction from the image carrier against a biasing force of the second biasing member so as to release a pressure contact state between the image carrier and the charging member.

5. The image carrier unit according to claim 4, wherein the pressure release rib protrudes from an inner side of the cover main body over an entire region of the image carrier along an axial direction thereof so that when the image carrier protective cover is slid along the axial direction of the image carrier, the pair of bearing members is moved simultaneously in the separating direction from the image carrier.

6. The image carrier unit according to claim 5, wherein each of the pair of hearing members includes a pressed portion that is to be contacted by the pressure release rib, and the pressed portion has an inclined surface formed therein to have an upward inclination toward a downstream side in a mounting direction of the image carrier protective cover, and when the image carrier protective cover is slid along the axial direction of the image carrier, the pressure release rib formed on the inner side of the cover main body rides on the inclined surface so as to be inserted between the main body portion and each of the pair of bearing members while pressing down the pressed portion.

7. The image carrier unit according to claim 4, further comprising:

a second cleaning member that rotates in contact with an outer circumferential surface of the charging member so as to clean the charging member, wherein each of the pair of bearing members includes a second bearing portion for rotatably supporting a second rotary shaft of the second cleaning member, the first bearing portion has such an elongated hole shape that an inner diameter thereof in the approaching/separating direction is larger than an inner diameter thereof in a direction orthogonal to the approaching/separating direction, when the pressure contact state between the image carrier and the charging member is released by the pressure release rib, the first rotary shaft of the charging member is separated from a part of an inner circumferential surface of the first bearing portion on a side near the second cleaning member, so that a biasing force of the second bearing member does not act between the charging member and the second cleaning member, and when the charging member is brought into pressure contact with the image carrier by demounting the image carrier protective cover, the first rotary shaft of the charging member makes contact with the part of the inner circumferential surface of the first bearing portion on the side near the second cleaning member, so that the biasing force of the second biasing member acts between the charging member and the second cleaning member.

8. An image forming apparatus comprising the image carrier unit according to claim 1.

* * * * *